United States Patent [19]

Nakamura

[11] Patent Number: 5,073,130

[45] Date of Patent: Dec. 17, 1991

[54] ELECTRICAL CONNECTOR

[75] Inventor: Masahiko Nakamura, Kitakatsuragigun, Japan

[73] Assignee: Hosiden Corporation, Yao, Japan

[21] Appl. No.: 619,414

[22] Filed: Nov. 29, 1990

[30] Foreign Application Priority Data

Dec. 4, 1989 [JP] Japan ..... 1-141019[U]

[51] Int. Cl.[5] ..... H01R 13/648

[52] U.S. Cl. ..... 439/607

[58] Field of Search ..... 439/108, 607-609

[56] References Cited

U.S. PATENT DOCUMENTS

| | | | |
|---|---|---|---|
| 4,653,837 | 3/1987 | Phillipson et al. | 439/607 |
| 4,718,866 | 1/1988 | Yamaguchi | 439/607 |
| 4,822,303 | 4/1989 | Nakamura et al. | 439/607 |
| 4,938,704 | 7/1990 | Fujiura | 439/607 |
| 4,943,244 | 7/1990 | Teck et al. | 439/607 |
| 4,959,626 | 9/1990 | Mouissie | 439/607 |
| 4,993,971 | 2/1991 | Matsuzaki et al. | 439/607 |
| 5,017,156 | 5/1991 | Sugiyama | 439/607 |

*Primary Examiner*—Paula A. Bradley

*Attorney, Agent, or Firm*—Jones, Tullar & Cooper

[57] ABSTRACT

The electrical connector in accordance with the present invention comprises: contact pieces having contacts and terminal portions, a connector body which houses and holds the contact pieces; a casing shield frame unit; and arms each having one end secured to the lateral wall portions of the shield frame unit and the other end, or free end, at which contacts are formed. The contacts which come in contact with a counter electrical connector, may be displaced inside of the shield frame unit, thus minimizing the height of the electrical connector as mounted on a printed circuit board.

5 Claims, 9 Drawing Sheets

ELECTRICAL CONNECTOR

BACKGROUND OF THE INVENTION

1. Field of the Invention

The present invention relates to an electrical connector having a shield frame to shut off an electrical noise, and more particularly to an electrical connector to be used as a socket (hereinafter referred to as socket).

As a socket so arranged as to shut off an electrical noise, there is known a socket in which the peripheries of contact pieces held by the socket body are surrounded by a metallic casing shield frame having projections. An electrical connector to be used as a plug (hereinafter referred to as plug) is selected as the counter member of the socket of the type above-mentioned. The plug has also a shield frame surrounding the peripheries of contact pieces. When the plug is inserted into the socket, the shield frame of the plug locally comes in contact with the projections of the shield frame of the socket. In such a contact state, the shield frame of the socket may be electrically securely connected to the shield frame of the plug. Thus, the shield frames may produce an excellent shielding effect as compared with the arrangement where the shield frames come in surface contact with each other.

2. Description of Related Art

Generally, the resiliency of a metallic plate used for the shield frame of a socket is not so great. Accordingly, a conventional socket is made such that, as shown in FIG. 12, a metallic plate is bent in the form of a casing to form a shield frame F and the ends of the metallic plate abut each other at an abutting portion Fl. The abutting portion Fl is located in the longitudinally center portion of the bottom wall of the shield frame F and projections T are formed in the vicinity of the abutting portion Fl.

When the socket is formed in the manner as shown in FIG. 12, the distance l between the abutting portion Fl and one end of the bottom wall of the shield frame F is relatively long. Accordingly, even though the resiliency of the metallic plate is not so great, the projections T are apt to be resiliently vertically displaced with the ends of the bottom wall serving as fulcrum points. In this connection, even though the socket S or a plug to be inserted in or removed from the socket S is twisted at the time of the insertion or removal of the plug, this does not involve the likelihood that the contact pressures between the projections T and the shield frame of the plug are damaged so prematurely.

However, when the plug is inserted in and removed from the conventional socket S, the shield frame of the plug gets over the projections T or is separated therefrom so that the bottom wall of the shield frame F is vertically displaced. Accordingly, when the socket S is to be mounted on a printed circuit board, it is required to form, between the bottom wall of the shield frame F and the printed circuit board, a space for allowing the bottom wall to be displaced. This presents the problem that the height of the socket S as mounted on the printed circuit board is increased by such an amount as to provide the space above-mentioned.

Further, in order that the projections T are satisfactorily maintained as contacted with the plug shield frame and the plug is smoothly inserted/removed in/from the socket S, it is required to enhance the precision at which the casing shield frame F of the socket S is fitted to the plug shield frame. This results in increased cost. Further, the increased fitting precision may assure good contacts between the projections T and the plug shield frame and smooth insertion/removal of the plug. On the other hand, however, there remarkably appears the influence of twist of the socket or plug when the plug is inserted in or removed from the socket. This disadvantageously causes the bottom wall of the shield frame F to be readily deformed.

SUMMARY OF THE INVENTION

The present invention is proposed in view of the problems above-mentioned.

It is an object of the present invention to provide a socket or electrical connector in which the shield frame thereof may be satisfactorily maintained, for a long period of time, as contacted with the shield frame of a plug, without substantial sacrifice of the insertion/-removal of the plug in/from the socket.

It is another object of the present invention to provide a socket or electrical connector of which the mounting height from a printed circuit board is reduced.

To achieve the objects of the present invention, the electrical connector in accordance with an embodiment of the present invention comprises:

contact pieces provided at the tips thereof with contacts and having terminal portions;

a connector body having (i) a main body which houses parts of the terminal portions of the contact pieces and (ii) a contact piece holding member projecting from the main body for holding the tips of the contact pieces at which the contacts are formed;

a casing shield frame unit surrounding the entire periphery of the contact piece holding member;

arms having one end secured to lateral wall portions of the shield frame unit which are opposite to lateral surfaces of the contact piece holding member, the one end being electrically connected to the shield frame unit; and contacts formed at the free ends of the arms and adapted to come in contact with or separated from the outside surfaces of lateral walls of the shield frame unit of a counter electrical connector which are inserted in or removed from the spaces formed between the casing shield frame unit and the contact piece holding member of the connector body.

According to the electrical connector having the arrangement above-mentioned, even though the shield frame is made of metal, the resiliency of which is not so great, the resilient deformation of the arms causes the contacts at the free ends of the arms to be readily displaced. It is therefore possible to satisfactorily assure, for a long period of time, a smooth insertion/removal of a counter electrical connector and a good electrical connection between the shield frame of the electrical connector of the present invention and the shield frame of the counter electrical connector. This substantially prevents a premature twisting deformation of the arms at the time when the counter electrical connector is inserted in or removed from the electrical connector of the present invention.

When mounting the electrical connector of the present invention on a printed circuit board, it is not required to form, between the electrical connector and the printed circuit board, a space for allowing the arms to be displaced, thus minimizing the mounting height of the electrical connector on the printed circuit board.

In the electrical connector in accordance with another embodiment of the present invention, the shield frame unit has a casing first frame and a second frame having arms.

According to the electrical connector above-mentioned, the first frame and the second frame may be independently replaced and the connector body of one type may be commonly used for the first and second frames manufactured in different manners, e.g., a frame as pressed out from a steel plate, a zinc die-cast frame, a resin-plated frame and the like.

In an electrical connector in accordance with a further embodiment of the present invention, the main body has a plurality of grooves which are opened in the back side and underside of the main body, and the terminal portions of the contact pieces project downwardly from the main body through these grooves.

According to the electrical connector above-mentioned, the terminal portions may be soldered to a printed circuit board by a dipping method.

In the electrical connector in accordance with still another embodiment of the present invention, the main body has a plurality of grooves which are opened in the back side and underside of the main body, and the terminal portions of the contact pieces are extended rearwardly of the main body substantially at the same level of that of the bottom surface of the main body.

The electrical connector above-mentioned may be surface-mounted on a printed circuit board.

In the electrical connector in accordance with a still further embodiment of the present invention, the first frame is fitted to the outside of the second frame into which the main body is fitted, so that the first and second frames are electrically connected to each other.

According to the electrical connector above-mentioned, the first frame and the second frame are electrically securely connected to each other, thus producing an excellent shielding effect.

Other various features and operational effects of the present invention will be apparent from the following description with reference to the attached drawings showing embodiments thereof.

DETAILED DESCRIPTION OF THE PREFERRED EMBODIMENTS

Figure 1:
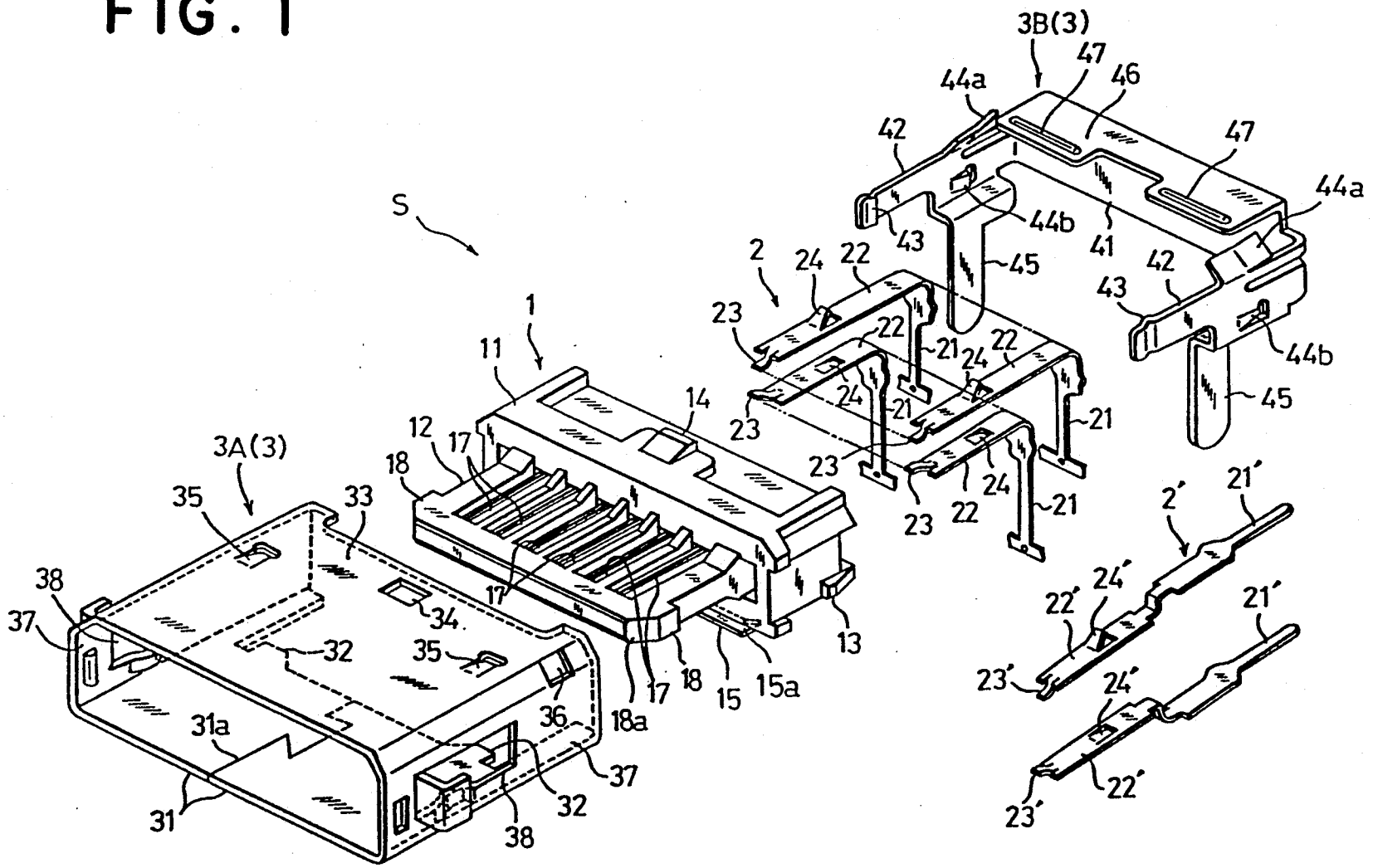
FIG. 1 is an exploded perspective view of an electrical connector in accordance with the present invention.

FIG. 1 shows a socket S including a connector body 1 having insulating properties, metallic contact pieces 2 and a metallic shield frame unit 3.

Figure 3:
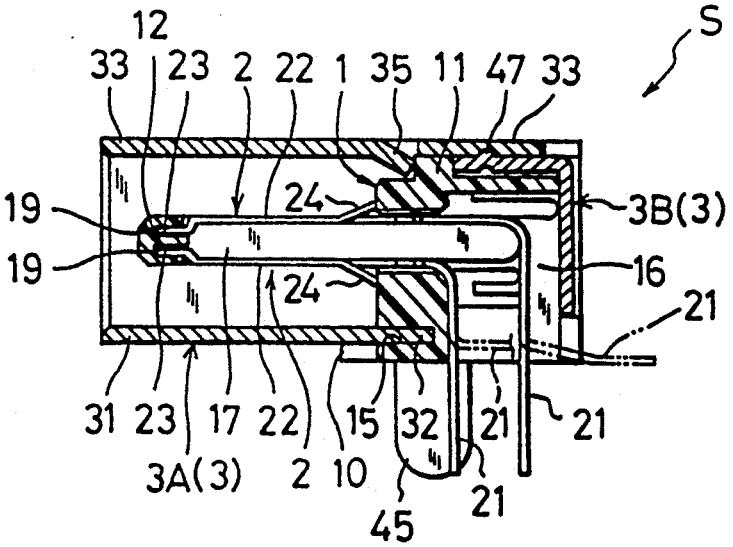
FIG. 3 is a vertical section view of the connector in FIG. 1.
Figure 4:
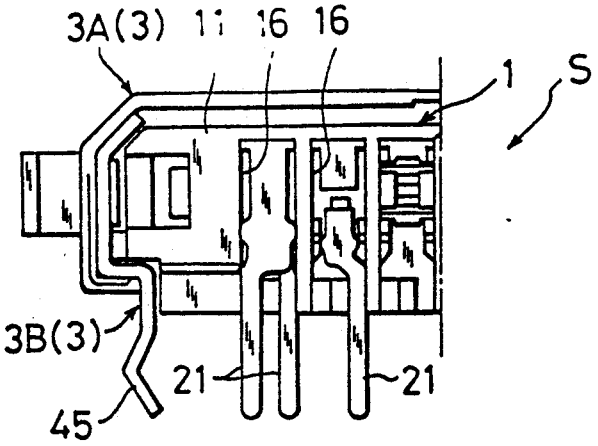
FIG. 4 is a back view of a portion of the connector in FIG. 1.

The connector body 1 is made of a plastic molded body and has, in a unitary structure, a main body 11 and a contact piece holding member 12. The contact piece holding member 12 projects from the main body 11 substantially at the center portion thereof in the height direction. The main body 11 is provided at the lower portions of both lateral sides thereof with engagement projections 13, and at the center of the top surface thereof with an engagement projection 14. The main body 11 is also provided in the lower portion of the front side thereof with a narrow groove 15. Concaves **15*a* are formed in both lateral sides of the inner wall of the narrow groove 15, the concaves 15*a* being obliquely notched more deeply than the narrow groove 15. As shown in FIG. 3, the main body 11 has a plurality of grooves 16 which are opened in the back side and the underside of the main body 11. These grooves 16 respectively communicate with a plurality of slit-like openings 17 formed in the contact piece holding member 12. The contact piece holding member 12 is provided at both lateral sides of the tip thereof with projections 18 having inclined end surfaces 18*a***.

Figure 5:
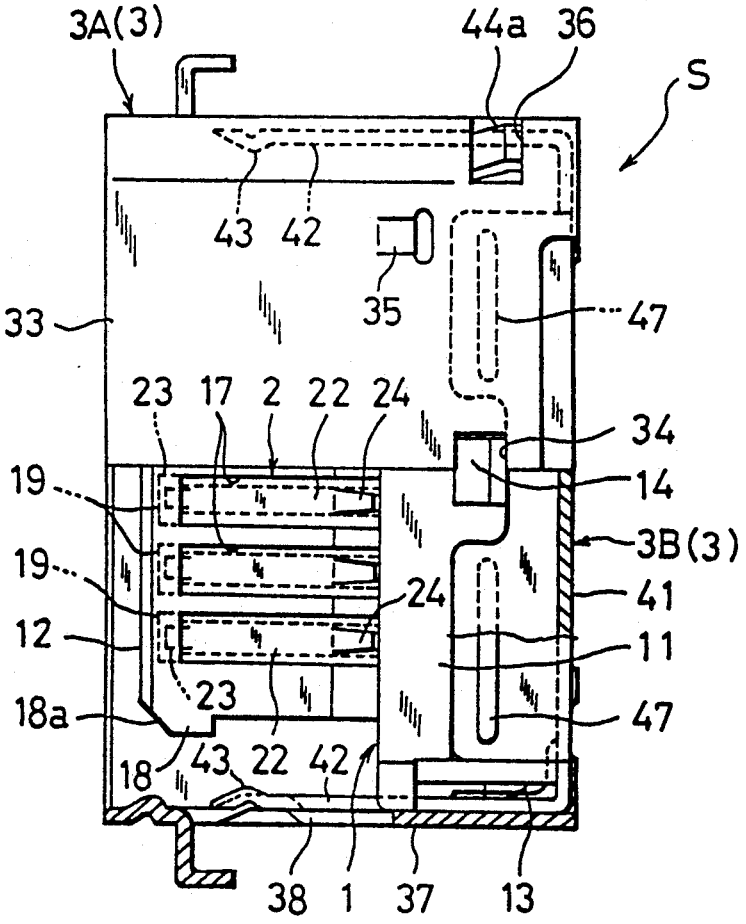
FIG. 5 is a plan view, with portions broken away, of the connector in FIG. 1.

Each of the contact pieces 2 is made of an L-shape metallic piece and has a terminal portion 21 and a horizontal piece portion 22. Each horizontal piece portion 22 is provided at the tip thereof with a small cut-raised engagement piece 23, and at the intermediate portion thereof with a cut-raised projection 24. The horizontal piece portions 22 are inserted into the main body 11 from the side of the grooves 16 and pass through the main body 11. Accordingly, the small engagement pieces 23 are inserted in and engaged with small holes 19 formed in the contact piece holding member 12, as shown in FIGS. 3 and 5. The projections-2 24 are engaged with the front end surface of the main body 11, thus preventing the contact pieces 2 from coming off from the main body 11. The terminal portions 21 of the contact pieces 2 are partly housed in the grooves 16 of the main body 11. The lower end portions of the terminal portions 21 project from the underside of the main body 11. Those parts of the terminal portions 21 which project downwardly from the underside of the main body 11, are adapted to be inserted into holes in a printed circuit board (not shown) and to be soldered thereto by a dipping method. The contact pieces 2 are held, in a vertically opposite manner, on and under the contact piece holding member 12. When assembling the contact pieces 2 with the main body 11, a plurality of contact pieces 2 are connected to one another by a tie bar, which is adapted to be separated from the contact pieces 2 after the contact pieces 2 are assembled.

A shield frame unit 3 comprises a first frame 3A and a second frame 3B.

The first frame 3A is made in the form of a casing by applying predetermined operations such as bending or the like to a single large metallic plate having relatively great rigidity. The first frame 3A has a bottom wall 31 of which a rear end portion is cut so that the rear end of the bottom wall 31 is located in the longitudinally center portion of the first frame 3A. The rear end of the bottom wall 31 has projecting pieces 32. Both transverse ends of the bent metallic plate abut each other at an abutting portion 31*a* at the transverse center of the bottom wall 31. The first frame 3A is provided in the center of the upper wall 33 thereof with an engagement hole 34. The upper wall 33 is provided at both lateral sides thereof with pawls 35 which are cut and inwardly raised. The upper wall 33 is also provided in both lateral corners thereof with engagement holes 36. Openings 38 are formed in the lateral walls 37 of the first frame 3A.

The second frame 3B is formed by applying predetermined operations such as bending or the like to a single metallic plate. The second frame 3B has a rear plate portion 41 which is provided at both lateral ends thereof with forwardly projecting arms 42. The arms 42 are provided at the free ends thereof with inwardly projecting contacts 43. The arms 42 have, in a unitary structure, outwardly turned engagement pawls 44*a*, inwardly turned engagement pawls 44*b* and downwardly projecting terminals 45. The rear plate portion 41 is turned to form a forwardly projecting upper plate portion 46. The upper plate portion 46 has upwardly projecting members 47.

Figure 2:
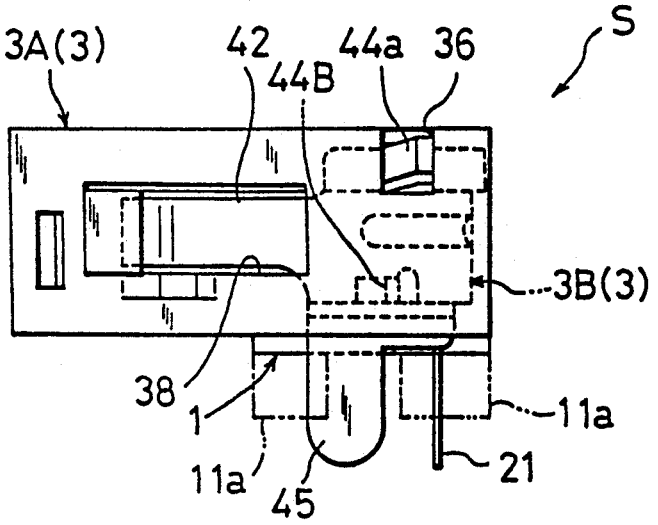
FIG. 2 is a side view of the connector in FIG. 1.

The second frame 3B is fitted, from the rear portion of the connector body 1, into the connector body 1 incorporating a predetermined number of contact pieces 2. The inwardly turned engagement pawls 44*b* of the second frame 3B are engaged with the engagement projections 13 of the connector body 1 from the front side thereof. As shown in FIG. 5, the arms 42 of the second frame 3B are opposite to the lateral sides of the contact piece holding member 12 of the connector body 1 with distances provided between the arms 42 and the lateral sides of the contact piece holding member 12. The first frame 3A is fitted to the connector body 1 and the arms 42 of the second frame 3B assembled with the connector body 1, from the front side thereof. As shown in FIG. 3, the pawls 35 of the first frame 3A come in contact and are engaged with the upper portion of the front end surface of the main body 11. As shown in FIG. 5, the engagement projection 14 of the main body 11 is engaged with the engagement hole 34 in the first frame 3A. Accordingly, the first frame 3A is secured to the connector body 1 and the engagement holes 36 in the first frame 3A are engaged with the outwardly turned engagement pawls 44*a* of the second frame 3B as shown in FIG. 2, so that both the frames 3A, 3B are secured to each other. As shown in FIG. 3, the projecting members 47 of the second frame 3B resiliently come in contact under pressure with the inner surface of the upper wall 33 of the first frame 3A, so that both the frames 3A, 3B are electrically connected securely to each other. The contacts 43 of the arms 42 face the openings 38. The rear end of the bottom wall 31 of the first frame 3A is fitted in the narrow groove 15 in the main body 11. The projecting pieces 32 are fitted in the concaves 15*a* and the rear end of the abutting portion 31*a* is supported by a supporting piece 10 of the main body 11.

In the socket S assembled in the manner above-mentioned, the main body 11 and the contact piece holding member 12 are surrounded by the first frame 3A, and the rear surface of the main body 11 is covered with the rear plate portion 41 of the second frame 3B. Accordingly, the shielding effect of the first frame 3A and the second frame 3B is extended on the connector body 1 and the contact pieces 2 substantially in their entireties. Thus, the first frame 3A and second frame 3B produce an excellent shielding effect.

The socket S described in the foregoing is adapted to be mounted on a printed circuit board (not shown) with the bottom wall 31 of the first frame 3A being opposite to the printed circuit board, and adapted to be soldered to the printed circuit board by a dipping method. In this connection, the terminal portions 21 of the contact pieces 2 and the terminals 45 of the second frame 3B project downwardly. In such a socket S, i.e., the socket S of the right-angle type which is adapted to be mounted on a printed circuit board with the bottom wall 31 of the first frame 3A being opposite to the printed circuit board, it is required to prevent a flux from entering inside of the connector body 1 at the time when the socket S is soldered. In this connection, stand portions 11*a* may be formed, as spacers, at the main body 11 as shown by virtual lines in FIG. 2, thereby to separate the main body 11 from the printed circuit board to prevent the flux from entering into the inside of the connector body 1. When using the surface-mounting method with the socket S of the right-angle type, the terminal portions 21 of the contact pieces 2 may be turned and extended, substantially at the same level as that of the bottom surface of the main body 11, toward the rear side of the main body 11, as shown by virtual lines in FIG. 3.

Figure 6A:
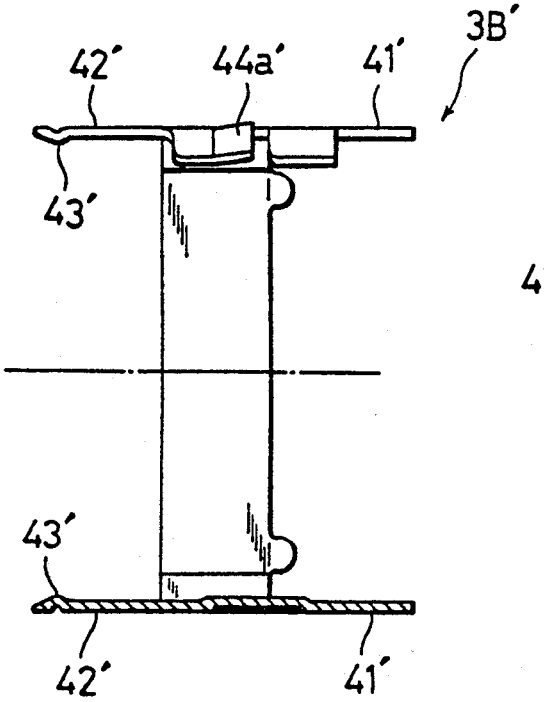
FIG. 6A is a plan view, with portions broken away, of a second frame of the straight-type to be used in the connector in FIG. 1.
Figure 6B:
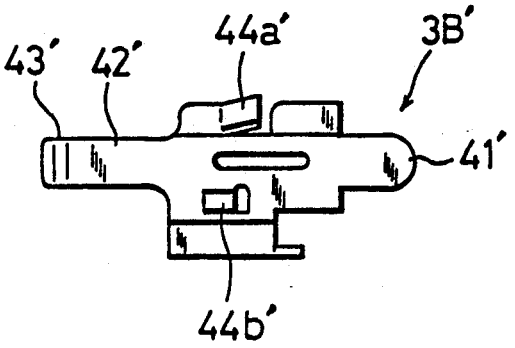
FIG. 6B is a side view of the second frame of the straight-type to be used in the connector in FIG. 1.

In a socket S of the straight type adapted to be mounted on a printed circuit board with the rear plate portion 41 of the second frame 3B being opposite to the printed circuit board, contact pieces 2′ as separately shown in FIG. 1 or a second frame 3B′ in FIGS. 6A and 6B may be used. In the contact pieces 2′ in FIG. 1, the terminal portions 21′ are extended rearwardly of the horizontal piece portions 22′. In the second frame 3B′ in FIGS. 6A and 6B, terminals 41′ are extended rearwardly of the arms 42′. In the socket S of the straight type, too, the flux preventive measure above-mentioned may be taken by lengthening the wider portions of the terminals 41′ of the second frame 3B′. Other portions of the contact pieces 2′ or the second frame 3B′ than those above-mentioned are substantially similar to those of the contact pieces 2 or the second frame 3B previously discussed in connection with FIGS. 1 to 5. Accordingly, like parts are designated by like numerals with an apostrophe added thereto, and the detailed description thereof is here omitted.

Figure 7A:
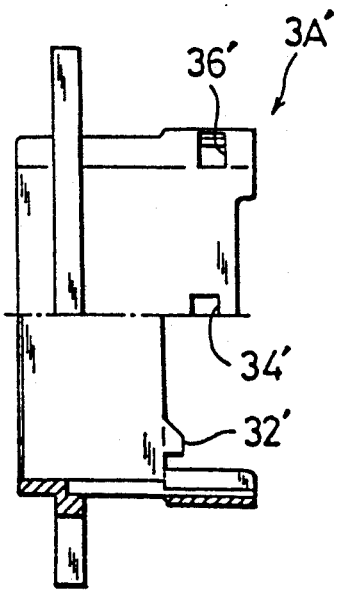
FIG. 7A is a plan view, with portions broken away, of the first frame which is a die-cast product.
Figure 7B:
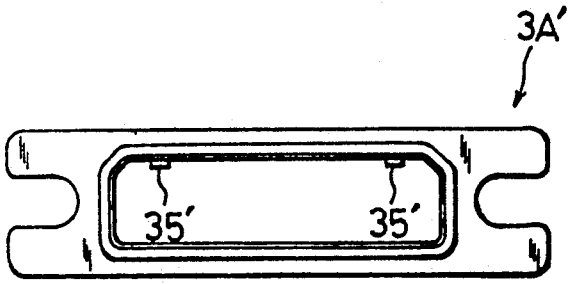
FIG. 7B is a front view of the first frame which is a die-cast product.

A first frame 3A′ shown in FIGS. 7A and 7B may be used instead of the first frame 3A. This first frame 3A′ is a die-cast product made of zinc. In view of the nature of the molding method, this first frame 3A′ is free from a joint seam and therefore improved in appearance as compared with the first frame 3A made of a metallic plate. In the first frame 3A′ in FIGS. 7A and 7B, like parts corresponding to those in the first frame 3A previously discussed in connection with FIGS. 1 to 5 are designated by like reference numerals with an apostrophe added thereto, and the detailed description thereof is here omitted.

Thus, the connector body 1 may be commonly used for both the socket S of the right-angle type and the socket S of the straight type. Further, the shield frame unit 3 is divided into the first frame 3A and the second frame 3B. Accordingly, even though there is used, as the first frame 3A, a die-cast product which is improved in appearance but hardly has resiliency, the arms 42 of the second frame 3B provide the shield frame unit 3 with required resiliency (to be discussed later).

In the embodiment above-mentioned, the shield frame unit 3 is divided into the first frame 3A and the second frame 3B, but the shield frame unit 3 may be made in a unitary structure. In such a case, the shield frame unit may be provided at the lateral sides thereof with long cut-raised arms and contacts may be disposed at the free ends of the arms.

Figure 8:
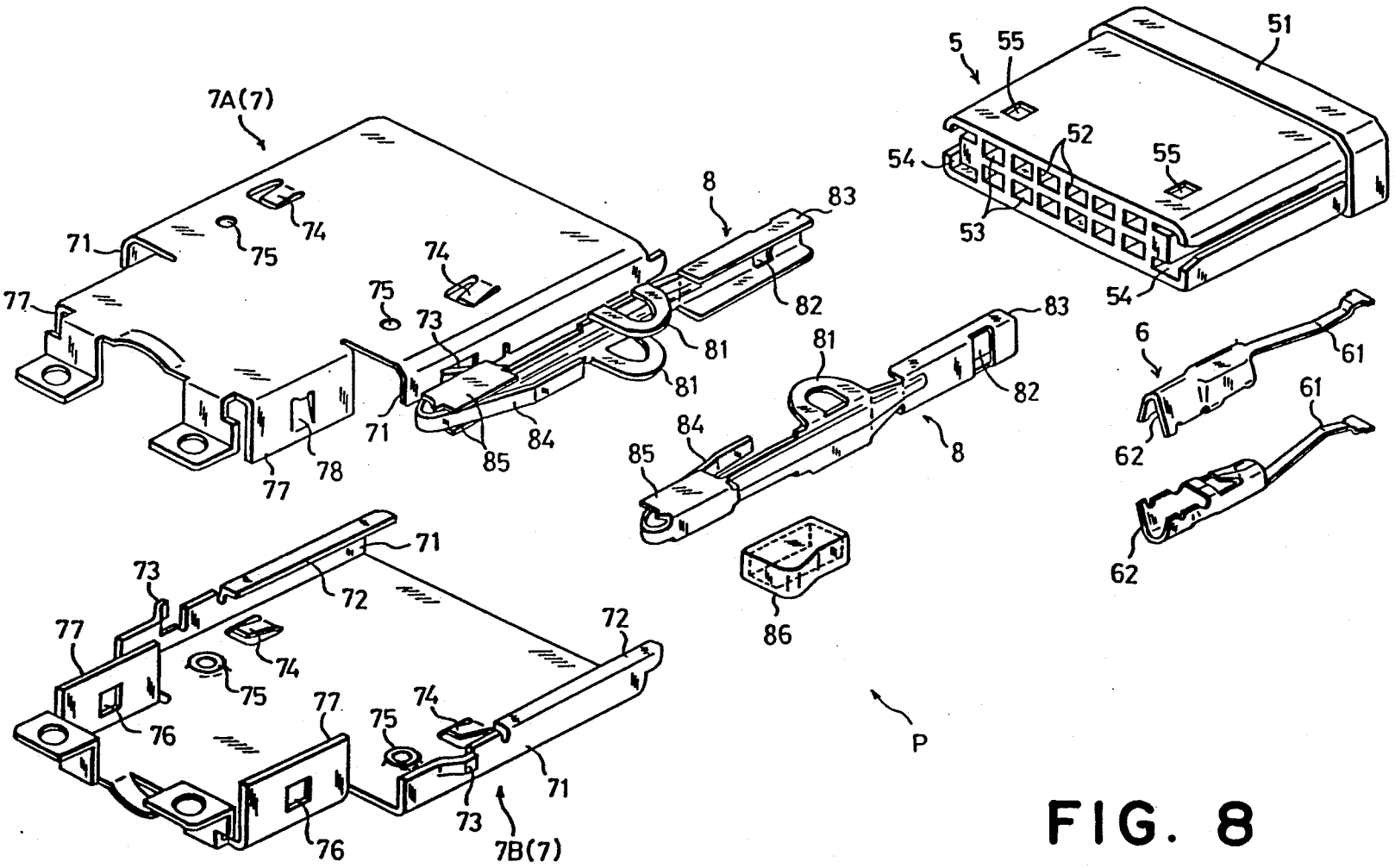
FIG. 8 is an exploded perspective view of a counter electrical connector to be inserted in and removed from the electrical connector of the present invention.

FIG. 8 shows a plug P to which the socket S is to be connected. The plug P has a main body 5 having insulating properties, metallic contact pieces 6, a metallic shield frame unit 7 and metallic locking levers 8.

The main body 5 is provided at the front end thereof with a flange 51 and inside thereof with a plurality of contact piece insertion holes 53 formed as partitioned by ribs in the form of a lattice. The main body 5 is provided in the lateral sides thereof with longitudinally extending engagement grooves 54. The main body 5 is also provided in the upper or lower surface thereof with engagement holes 55.

The contact pieces 6 are made of metallic pieces. Each of the contact pieces 6 is provided at the tip thereof with a contact 61 and at the rear end thereof with a forked holding piece 62. When assembling the contact pieces 6 with the main body 5, a plurality of contact pieces 6 are connected to one another with a tie bar. This tie bar will be cut at the time when the forked holding pieces 62 of the contact pieces 6 are calked with electric wires to be discussed later. The contact pieces 6 are respectively inserted into the contact piece insertion grooves 53 in the main body 5 and assembled with the main body 5 such that the contact pieces 6 do not come out therefrom.

The shield frame unit 7 is divided into an upper frame 7A and a lower frame 7B. The lower frame 7B has a U-shape section and is provided at both lateral sides thereof with leg portions 71. The leg portions 71 are provided at the edges of the front ends thereof with inwardly turned engagement pieces 72 and at the rear ends thereof with outwardly turned engagement pawls 73 as cut and raised. The lower frame 7B is provided on the bottom plate thereof with engagement pawls 74 and projections 75. The upper frame 7A has an arrangement substantially identical with that of the lower frame 7B. The upper frame 7A is different from the lower frame 7B in that the upper frame 7A has engagement pawls 78 corresponding to engagement holes 76 formed in the lower frame 7B. Thus, like parts of the upper frame 7A are designated by like reference numerals used in the lower frame 7B, and the detailed description thereof is here omitted.

Each of the locking levers 8 is provided at the longitudinal center portion thereof with a pair of upper and lower ring portions 81. Each of the locking lever 8 is provided at one end thereof with a U-shape engagement piece 83 having a lock hole 82. Each locking lever 8 is also provided at the other end thereof with a spring plate portion 84 turned into a U-shape. Each locking lever 8 is also provided at the other end thereof with a knob attaching portion 85 on which a knob 86 is mounted.

Figure 9:
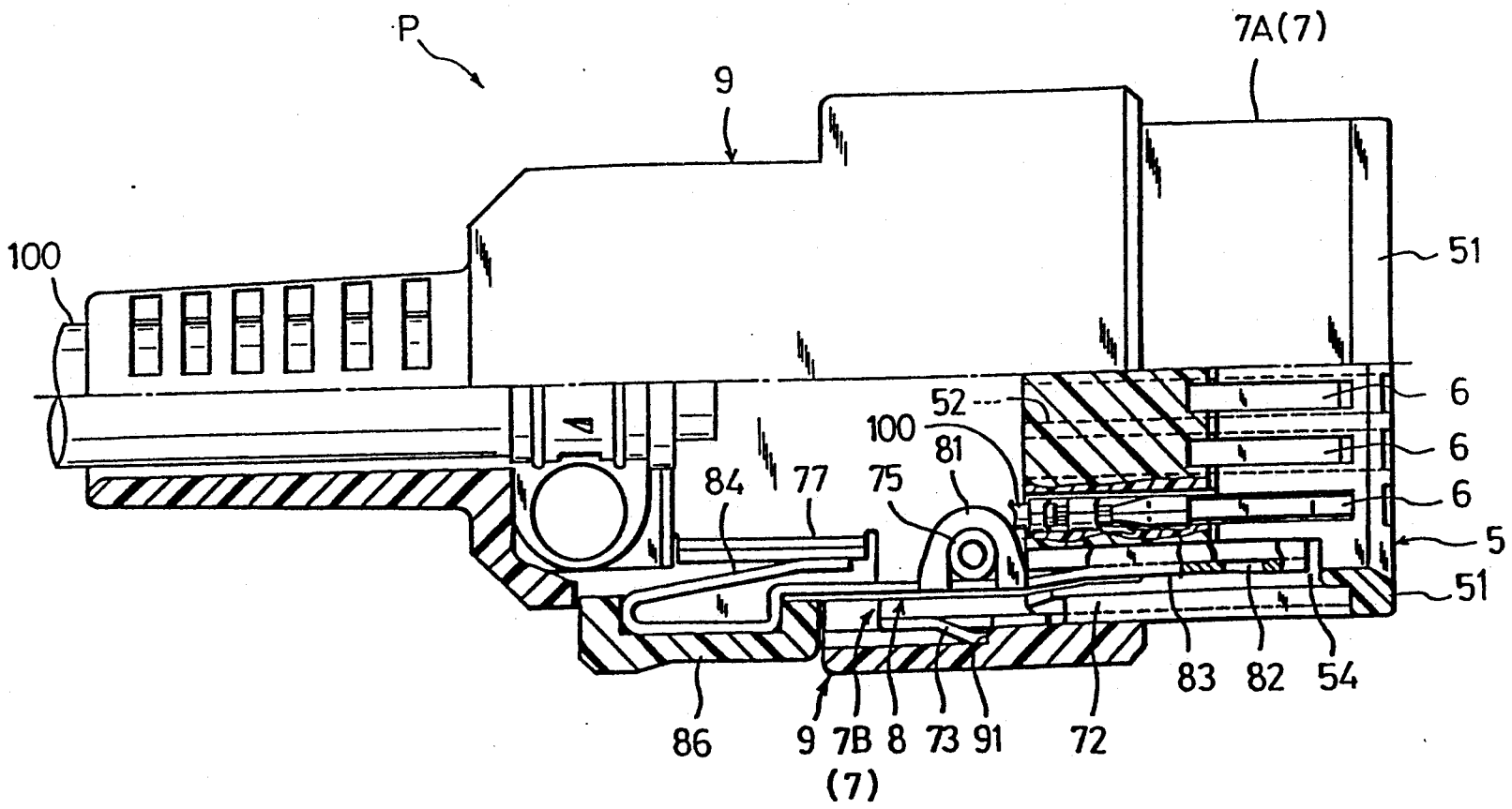
FIG. 9 is a plan view, with portions broken away, of the counter electrical connector.

The upper frame 7A and the lower frame 7B overlap each other. The engagement pawls 78 of the lower frame 7B are engaged with the engagement holes 76 of the lower frame 7B so that the frames 7A, 7B are connected to each other. The locking levers 8 are housed in both lateral ends of the space formed as surrounded by the upper and lower frames 7A, 7B thus connected. In such a state, pairs of upper and lower ring portions 81 of the locking levers 8 are fitted in and rotatably supported by the projections 75 of the upper and lower frames 7A, 7B. The overlapping engagement pieces 72 of the upper and lower frames 7A, 7B are inserted into the engagement grooves 54 in the main body 5, and the engagement pawls 74 are engaged with the engagement holes 55 in the main body 5, thereby to prevent the main body 5 from coming out from the frames 7A, 7B. As shown in FIG. 9, a cap 9 previously put on a signal cable 100 is fitted to the upper frame 7A and the lower frame 7B. The outwardly turned engagement pawls 73 of the upper and lower frames 7A, 7B are engaged with stepped portions 91 of the cap 9, thereby to prevent the frames 7A, 7B from coming out from the cap 9. The electric wires of the signal cable 100 are respectively connected to the contact pieces 6.

In the plug P thus assembled, the locking levers 8 are disposed in the lateral ends of the space formed as surrounded by the shield frame unit 7. Accordingly, the height of the plug P is not increased. This advantageously prevents the plug P from being made in large size even though the locking levers 8 are disposed.

In the plug P, the spring plate portions 84 of the locking levers 8 are opposite to plate portions 77 of the upper and lower frames 7A, 7B, as shown in FIG. 9. Further, the entire periphery of the main body 5 housing the contact pieces 6 is surrounded by the upper frame 7A and the lower frame 7B. Thus, the shielding effect by the frame unit 7 extends over the main body 5 housing the contact pieces 6 and the entire exposed portion of the signal cable 100. Thus the shield frame unit 7 produces an excellent shielding effect. Further, the upper frame 7A and the lower frame 7B are inserted, as overlapping each other, into the engagement grooves 54 in the main body 5. This increases the strength of the plug P in its entirety.

Figure 10:
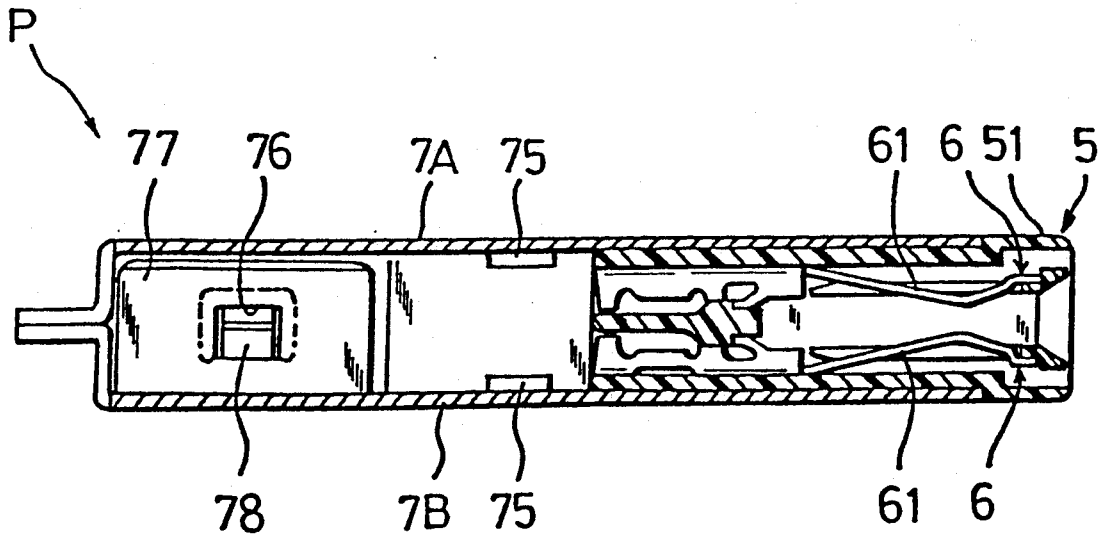
FIG. 10 is a vertical section view of the counter electrical connector.
Figure 11:
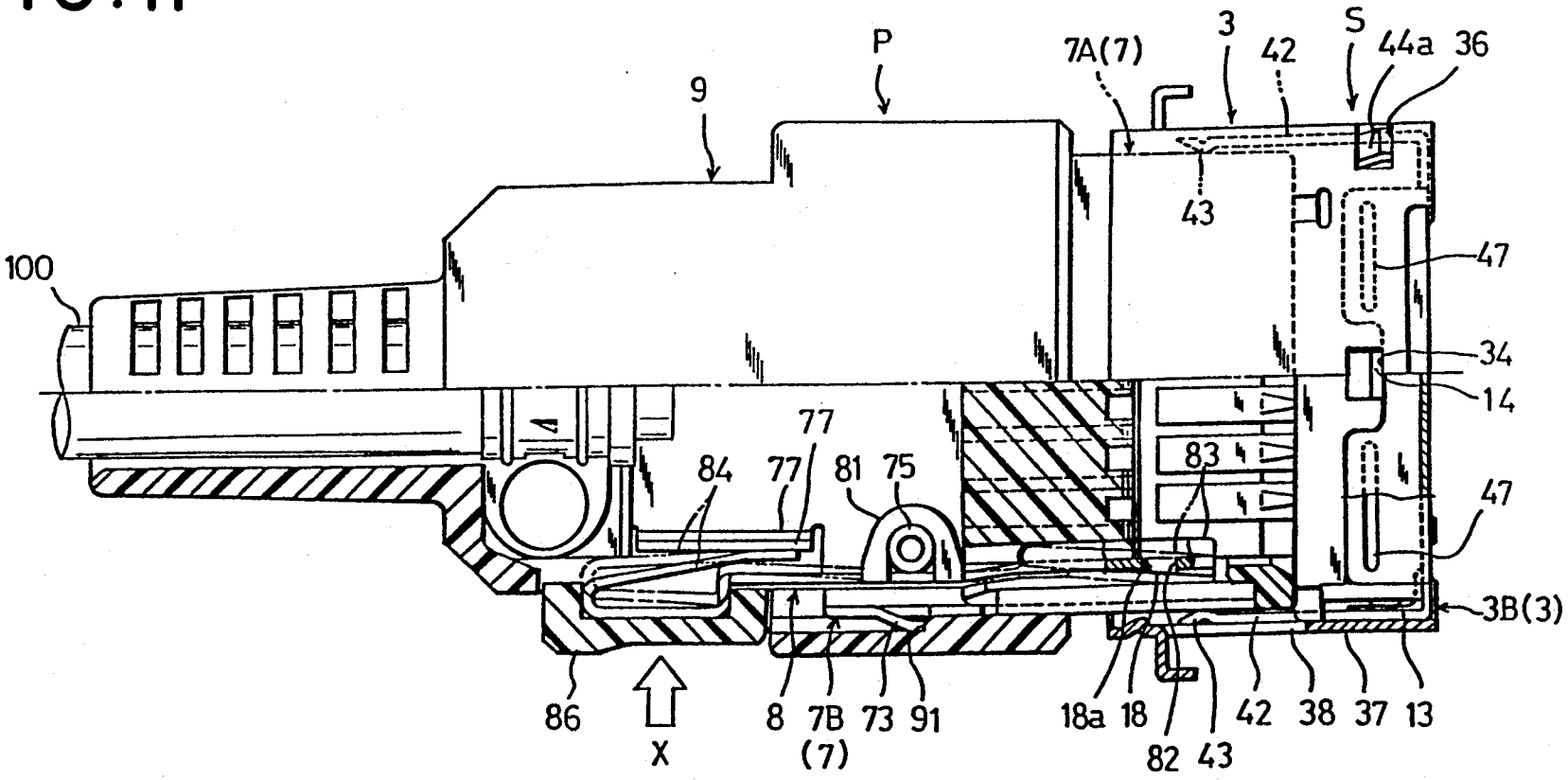
FIG. 11 is a plan view, with portions broken away, of the electrical connector in accordance with the present invention as connected to the counter electrical connector.
Figure 12:
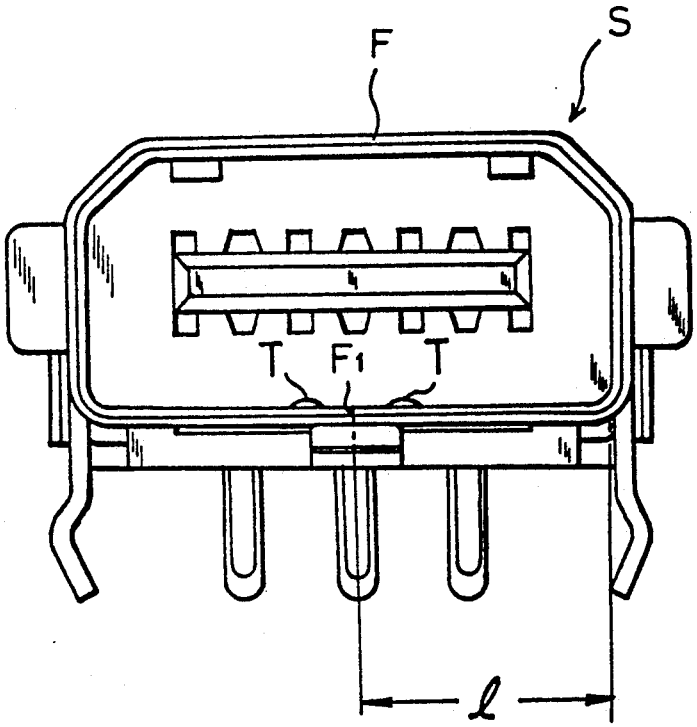
FIG. 12 (PRIOR ART)
FIG. 12 is a back view of a conventional electrical connector.

FIG. 11 shows the socket S discussed in connection with FIGS. 1 to 5 as connected to the plug P discussed in connection with FIGS. 8 to 10.

When the plug P is inserted into the socket S, both the frame units 3, 7 come in contact with each other so that the connected portions of the plug P and the socket S are entirely surrounded by the frame units 3, 7. Thus, the frame units 3, 7 produce an excellent shielding effect. The contacts 43 at the free ends of the arms 42 of the second frame 3B in the socket S, come in contact with the outside surfaces of the lateral walls of the shield frame unit 7 of the plug P. When the plug P is pulled out, the resiliency of the arms 42 causes the contacts 43 to be returned to the original positions, so that the socket S is prepared for the next insertion of the plug P. When the plug P is inserted in and removed from the socket S in the manner as above-mentioned, the contacts 43 at the free ends of the arms 42 may be displaced, without force, due to the resilient deformation of the arms 42, even though second frame 3B is made of metal of which resiliency is not so great. Accordingly, the plug P may be smoothly inserted and removed. Further, even though the plug P is repeatedly inserted in and removed from the socket S, the contacts 43 resiliently come in contact, under suitable contact pressure, with the shield frame unit 7 of the plug P. In addition, the contacts 43 are locally strongly contacted under pressure with the shield frame unit 7, so that the shield frame units 3, 7 are electrically securely connected to each other. Thus, an excellent shielding effect is produced on the connected portions of the socket S and the plug P with the smooth insertion and removal of the plug P not sacrificed. Even though the plug P is twisted when the plug is inserted or removed, the arms 42 are resiliently deformed, without force, following such a twist. This prevents the arms 42 from being deformed to such an extent as not to be restored.

In the socket S, the arms 42 are disposed at those lateral wall portions of the shield frame unit 3 which are opposite to the lateral sides of the contact piece holding member 12 of the connector body 1. It is therefore not required to form, between the socket S and a printed circuit board on which the socket S is mounted, spaces for allowing the arms 42 to be displaced.

In the course that the plug P is inserted into the socket S, the tips of the engagement pieces 83 of the locking levers 8 are pushed and directed outside with respect to the projections 75 by the inclined end surfaces 18*a* of the projections 18 in the socket S. At this time, the spring plate portions 84 strike against the plate portions 77 of the shield frame unit 7, causing the spring plate portions 84 to be deformed against the resiliency thereof, as shown by virtual lines in FIG. 11. When the tips of the engagement pieces 83 get over the projections 18, the spring loads of the spring plate portions 84 cause the engagement pieces 83 to be inwardly displaced so that the lock holes 82 are fitted to the projections 18. Accordingly, the projections 18 are engaged with the lock holes 82 so that the plug P is locked by the socket S, preventing the plug P from coming out therefrom.

For removing the plug P from the socket S, the knobs 86 are pushed in a direction shown by an arrow X in FIG. 11. Then, as shown by the virtual lines in FIG. 11, the spring plate portions 84 are pushed to the plate portions 77, causing the spring plate portions 84 to be deformed. At the same time, the engagement pieces 83 are turned outside with respect to the projections 75. This causes the projections 18 to come out from the lock holes 82, thus releasing the locked state. The knobs 86 are disposed at such positions that the plug P is grasped with the hands when removing the plug P. Accordingly, a force in the direction shown by the arrow X is naturally applied to the knobs 86 by the plug removing force. This is very convenient in use.

There are instances where, when the plug P is removed from the socket S, the plug P is pulled with a strong force without the lock state released. In this case, the projections 18 are always sheared to cause the plug P to be pullsed out since the locking levers 8 are made of metal and the projections 18 are molded bodies of plastic which is apt to be sheared more easily than metal. However, even though the projections 18 are sheared, this exerts no influence upon the signal transmission/reception function and shield function of the plug P and the socket S. Accordingly, the continuous use of the plug P as sheared is allowed with no inconveniences. On the other hand, when the lock mechanism is made by combining, for example, the metallic locking levers 8 with metallic projections, forcible removal of the plug P may not only cause the projections to be deformed without sheared or the locking levers 8 to be deformed, but also cause the peripheral portions of the locking levers 8 and the projections to be broken or damaged. Thus, the plug P cannot be continuously used with the locking levers 8 or the projections deformed.

What is claimed is:

1. An electrical connector comprising:

contact pieces provided at the tips thereof with contacts and having terminal portions;

a connector body having (i) a main body which houses parts of said terminal portions of said contact pieces and (ii) a contact piece holding member projecting from said main body for holding said tips of said contact pieces at which said contacts are formed;

a casing shield frame unit surrounding the entire periphery of said contact piece holding member;

arms having one end secured to lateral wall portions of said shield frame unit which are opposite to lateral surfaces of said contact piece holding member, said one end being electrically connected to said shield frame unit; and contacts formed at the free ends of said arms and adapted to come in contact with or separated from the outside surfaces of lateral walls of the shield frame unit of a counter electrical connector which are inserted in or removed from the spaces formed between said casing shield frame unit and said contact piece holding member of said connector body.

2. An electrical connector according to claim 1, wherein the shield frame unit includes a casing first frame and a second frame having the arms.

3. An electrical connector according to claim 2, wherein the first frame is fitted to the outside of the second frame into which the main body is fitted, so that said first and second frames are electrically connected to each other.

4. An electrical connector according to claim 3, wherein the main body has a plurality of grooves which are opened in the back side and underside of the main body, and the terminal portions of the contact pieces project downwardly from said main body through said grooves.

5. An electrical connector according to claim 3, wherein the main body has a plurality of grooves which are opened in the back side and underside of the main body, and the terminal portions of the contact pieces are extended rearwardly of said main body substantially at the same level as that of the bottom surface of said main body.

* * * * *